US005659864A

United States Patent [19]

Oka et al.

[11] Patent Number: 5,659,864

[45] Date of Patent: Aug. 19, 1997

[54] DUAL IMAGE FORMING APPARATUS AND METHOD OF USING SAME

[75] Inventors: Takeki Oka, Toyohashi; Hirokatsu Shimada, Toyokawa, both of Japan

[73] Assignee: Minolta Co., Ltd., Osaka, Japan

[21] Appl. No.: 397,863

[22] Filed: Mar. 2, 1995

[30] Foreign Application Priority Data

Apr. 22, 1994 [JP] Japan ..... 6-084440
Apr. 27, 1994 [JP] Japan ..... 6-089639

[51] Int. Cl.[6] ..... G03G 15/20

[52] U.S. Cl. ..... 399/321; 399/67; 399/328; 219/216

[58] Field of Search ..... 355/326 R, 327, 355/328, 285, 289, 290; 219/216; 430/99, 124, 126, 42, 44, 45, 54; 399/178, 179, 54, 321, 69, 67, 328, 330, 335

[56] References Cited

U.S. PATENT DOCUMENTS

| | | | |
|---|---|---|---|
| 2,986,466 | 5/1961 | Kaprelian | 430/44 |
| 3,413,063 | 11/1968 | Young | 430/126 X |
| 4,076,407 | 2/1978 | Place, Jr. . | |
| 4,286,031 | 8/1981 | Kuehnle et al. | 430/126 X |
| 4,928,148 | 5/1990 | Higashi | 355/290 |
| 4,931,839 | 6/1990 | Tompkins et al. . | |
| 4,972,236 | 11/1990 | Hasegawa . | |
| 5,001,519 | 3/1991 | Saito | 355/285 |
| 5,073,799 | 12/1991 | Watanabe | 355/285 |
| 5,200,285 | 4/1993 | Carrish | 355/285 X |
| 5,258,809 | 11/1993 | Wiedemer | 355/326 R X |
| 5,296,904 | 3/1994 | Jackson | 355/290 |
| 5,300,386 | 4/1994 | Kanbayashi et al. | 430/99 |
| 5,319,426 | 6/1994 | Baruch et al. | 355/285 |
| 5,325,165 | 6/1994 | Ohgita et al. | 355/285 |
| 5,385,800 | 1/1995 | Wilson et al. | 430/126 X |
| 5,401,601 | 3/1995 | Sacripante et al. | 430/126 X |
| 5,407,773 | 4/1995 | Furuta et al. | 430/99 X |
| 5,504,567 | 4/1996 | Satoh et al. | 355/285 |

FOREIGN PATENT DOCUMENTS

| | | |
|---|---|---|
| 60-142374 | 7/1985 | Japan . |
| 4-333868 | 11/1992 | Japan . |
| 5-241475 | 9/1993 | Japan . |

*Primary Examiner*—Matthew S. Smith
*Attorney, Agent, or Firm*—Burns, Doane, Swecker & Mathis, LLP

[57] ABSTRACT

An image forming apparatus includes a first printing unit which forms a first image on a sheet with a first printing material and fixes the first image thereon by heat application; and a second printing unit which forms a second image with a second printing material on the sheet having the first image formed by the first printing unit, and fixes the second image thereon by heat application; the second printing material has a lower melting temperature than the first printing material and the second printing unit applies a lower temperature heat for fixation of the second image than the first printing unit.

27 Claims, 6 Drawing Sheets

DUAL IMAGE FORMING APPARATUS AND METHOD OF USING SAME

BACKGROUND OF THE INVENTION

1. Field of the Invention

The present invention relates to a dual image forming apparatus, specifically, an apparatus provided with two imaging units, a first imaging unit which fixes a first printing material to a sheet and a second imaging unit which fixes a second printing material to the aforementioned sheet having the first printing material thereon to create an image.

2. Description of Related Art

Conventional dual image forming apparatus have been provided with two sets of imaging units, each of which includes a toner image generation means which creates a toner image on a sheet and a fixing means which heats and melts the toner image to fuse it to a sheet. A first toner image is fixed on the sheet by said first imaging unit, and a second toner image is fixed on the sheet by said second imaging unit.

However, if the melting temperature of the first toner and the second toner is identical, and if the first and second fixing means use identical fixation conditions, for example, if the fixation temperature and pressure applied to toner during fixation are set identically in the dual image forming apparatus, the first toner, which has already been fixed, would be remelted by the second fixing means and would run on the sheet, or the melted first toner would mix with the second toner and smudge.

Furthermore, moisture in copy sheets is reduced by the heat applied during the fixing process. The reduction in moisture raises the electrical resistance of the sheet. Accordingly, after a first fixing process, the efficiency of transferring the printing material in subsequent imaging processes decreases when other transfer conditions are held constant in individual units. As a result, the image density falls.

SUMMARY

The present invention eliminates the aforementioned disadvantages by providing a dual image forming apparatus in which printing material which melts at a higher temperature than a second printing material under identical conditions may be used as a first printing material, and in which the heating temperature of a second fixing device is set at a temperature below the melting temperature of said first printing material in the fixation conditions of said second fixing device.

In addition, changes in the electrical resistance of the sheets can be overcome if the printing material, which is stored in each unit of the image forming apparatus, is adjusted so that the amount of charge per unit volume decreases in accordance with a number of previous imaging operations. Various methods of adjusting the amount of charge of printing material are available. One such method includes adjusting the amount of charge by increasing the particle diameter of the printing material.

DESCRIPTION OF THE PREFERRED EMBODIMENTS

The present invention is explained below with reference to the appended drawings.

Figure 1:
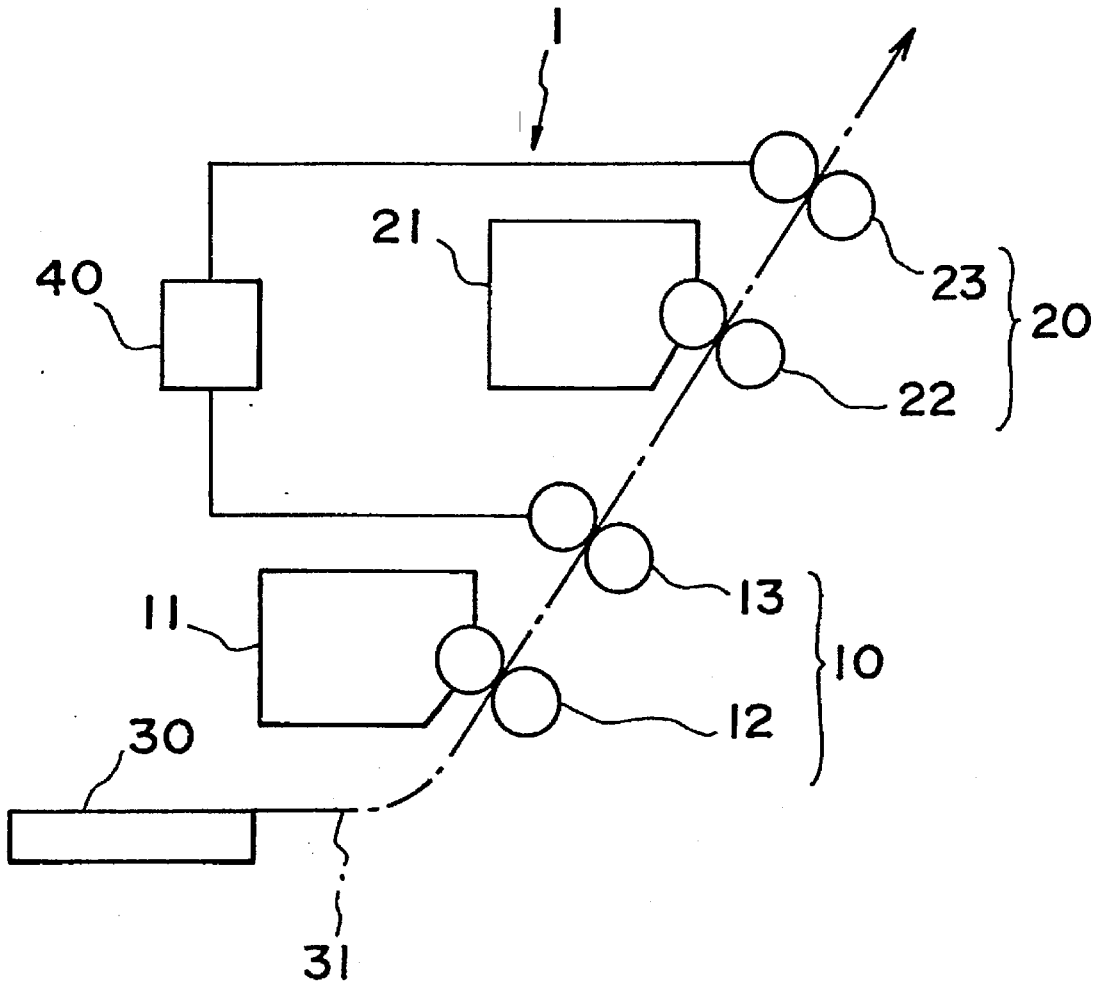
FIG. 1 is a schematic view of a dual image forming apparatus pursuant to the present invention.

In FIG. 1, a dual image forming apparatus 1 forms a two-color composite image on one side of a sheet of ordinary paper or film such as synthetic resin. It is provided with a first electronic photographic unit 10 that creates a first color image and a second electronic photographic unit 20 that creates a second color toner image on the sheet overlapping said first color toner image.

The sheet in said dual image forming apparatus 1 is transmitted by a sheet feeding device 30, for example, a sheet feeding device with a setting of known paper-feeding force. It is transported along a sheet transport path 31, which is indicated by a virtual line.

Said first unit 10 is provided with a first imaging unit 11, a first transfer device 12 and a first fixing device 13. Said first imaging unit 11 incorporates a photosensitive unit, a charge device and a developer in a single integrated unit. A first electrostatic latent image is formed through known electronic photographic methods by an image exposure device (not illustrated) which exposes a photosensitive unit to a beam which is modulated as a function of a first color image signal.

Said first toner image is transferred by the first the transfer device 12 to a sheet which is transported along said sheet transport path 31. At this time, the first toner image can be removed merely by applying a physical force thereto since it adheres to said sheet simply by static electricity. First fixing device 13 comprises a parallel pair of fixing rollers, for example, a heating roller which incorporates a heater and a pressure roller which applies a prescribed fixation force to said heating roller. The sheet which supports the first toner image is heated while held between the two fixing rollers. By so doing, said first toner image is melted and fixed to said sheet.

Said second unit 20 is provided with a second imaging unit 21, a second transfer device 22 and a second fixing device 23 similar to the first unit 10. Second imaging unit 21 forms a second electrostatic latent image similar to the first imaging unit 11 by an image exposure device (not illustrated) which exposes a photosensitive unit to a beam which is modulated as a function of a second color image signal.

Said second electrostatic latent image is developed by a developer which accommodates a second color toner to create a second toner image. The second toner which is accommodated in said developer may have a color different from that of said first toner. For example, if black toner is used in the first toner, then red toner could be used in the second toner. Next, the second toner image is transferred by the second transfer device 22 to a sheet which is transported along said sheet transport path 31, and a second toner image is overlapped on said first toner image. At this time, the first toner image is fixed to the sheet, but the second toner image is not fixed. The second toner image can easily be removed by applying a physical force. Second fixing device 23 may have the same structure as that the first fixing device 13. It comprises a parallel pair of fixing rollers, specifically, a heating roller and a pressure roller which hold and transport the sheet and which melt the second toner and fix it to said sheet. Then, the sheet to which the first toner image and the second toner image have been fixed is discharged from a discharge unit, which is not illustrated.

Figure 2:
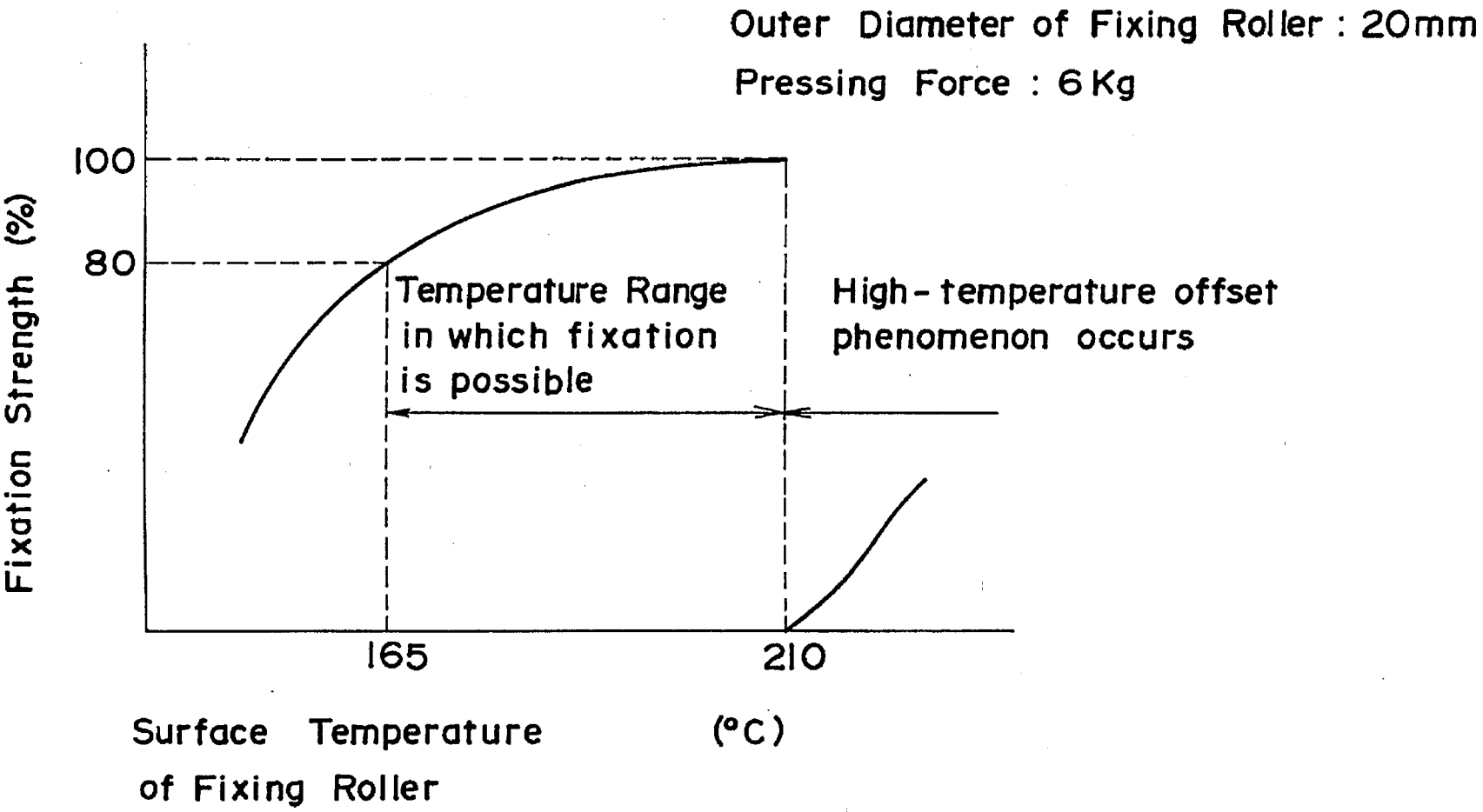
FIG. 2 is a diagram showing the temperature range in which fixation of a first toner is possible.

The properties Of the first toner and of the second toner which are used in the aforementioned image forming apparatus are explained below. The first toner is molten fixed to a sheet with 80% to 100% fixation strength by two fixing rollers of 20 mm outer diameter and 225 mm length in a fixing device that applies 6 kg of pressing force when the surface temperature of said fixing rollers is 165° C. to 210° C. See FIG. 2. So-called high-temperature offset phenomenon occurs at a temperature of 210° C., and is a phenomenon in which molten toner sticks to the surface of the fixing roller. The temperature range in which toner is molten fixed with 80 to 100% fixation strength is termed the "temperature range in which fixation is possible". Furthermore, the fixation strength denotes the degree of adhesion of toner to sheet, and is represented by Expression 1 below.

Expression 1

$$\text{Fixation strength}=(ID2/ID1)\cdot 100(\%)$$

ID1: Image density of a solid colored image of a copy

Figure 3:
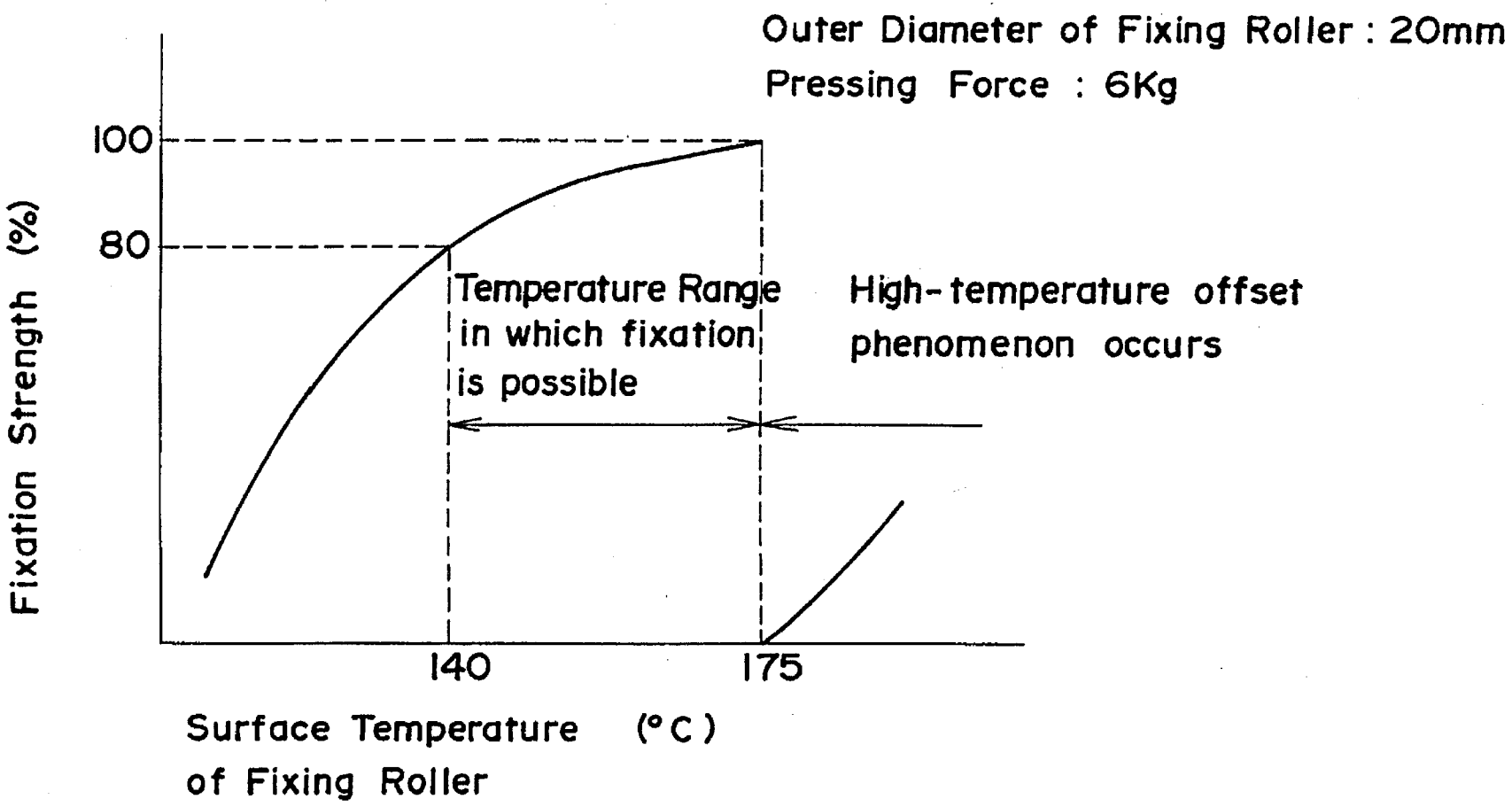
FIG. 3 is a diagram showing the temperature range in which fixation of a second toner is possible.

ID2: Image density of the solid colored image of the copy after rubbing the image a fixed number of times at constant pressure with an erasure The second toner is toner which is molten fixed to a sheet with 80% to 100% fixation strength when the temperature on the outer circumferential surface of a fixing roller under identical conditions is 140° C. to 175° C., as shown in FIG. 3. High-temperature offset phenomenon begins at a temperature of 175° C.

The melting temperature of toner can be adjusted by adjusting the blending rates of the main constituent resins of toner (for example, polyester resin) which are high molecular-weight resin with. average molecular weight of 5000 (resin with a Gaussian distribution having a peak at molecular weight of approximately 5000) and low molecular-weight resin with average molecular weight of 2000 (resin with a Gaussian distribution having a peak at molecular weight of approximately 2000). Specifically, when adjusting the melting temperatures of the first toner and the second toner, the first toner would have a proportion of high molecular-weight resin to low molecular-weight resin of 2:1 while the second toner would have a ratio of 1:2.

Figure 4:
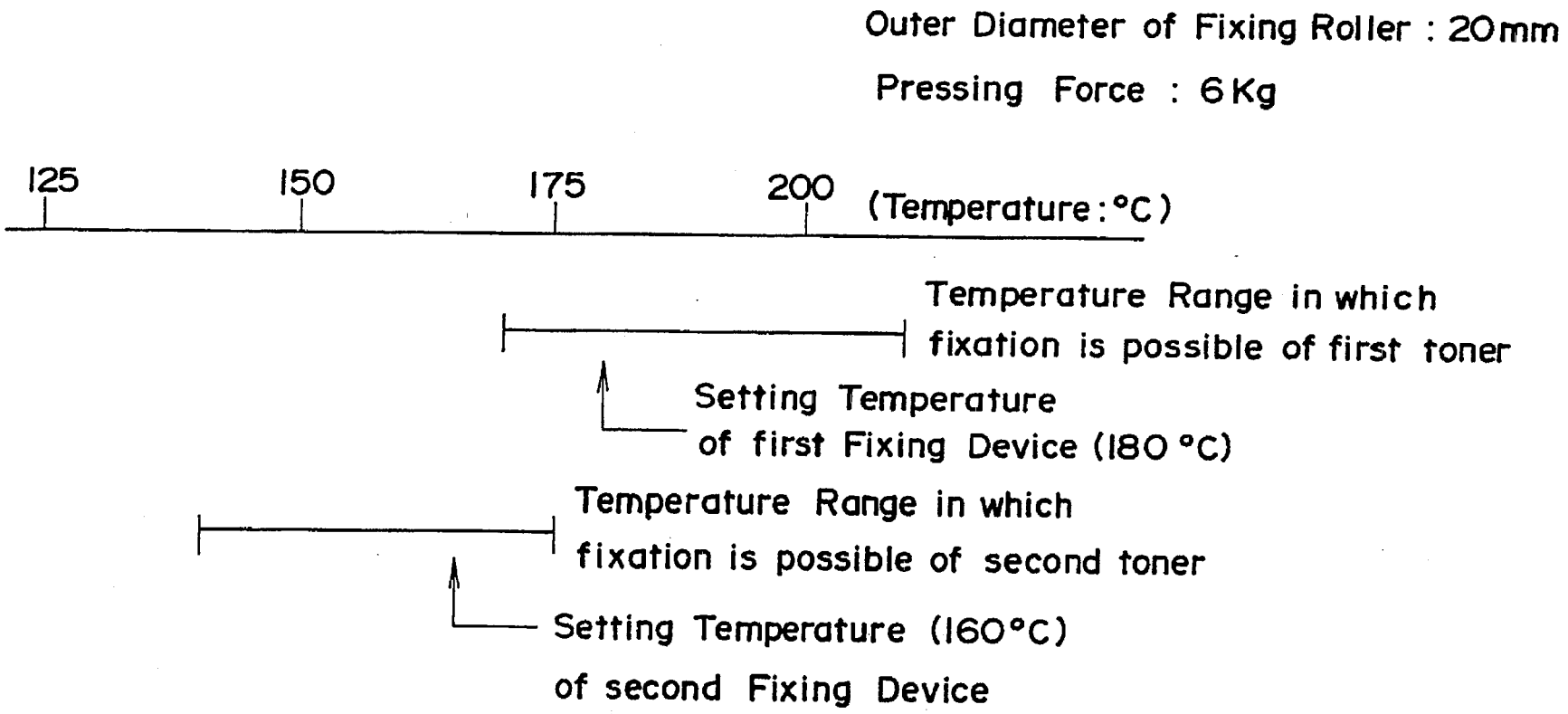
FIG. 4 is a diagram showing the temperature range in which fixation of the first toner and the second toner is possible when using a fixing roller having a 20 mm outer diameter and a 6 kg pressing force as well as the set temperatures of a first fixing device and a second fixing device.

Controlling the temperature of fixing devices 13 and 23 is described hereinafter. The temperature on the outer circumferential surface of the heating roller in first fixing device 13 is set by temperature control 40 so as to be in the temperature range in which fixation of first toner is possible (165° to 210° C.), preferably at 180° C., as shown in FIG. 4, when the pressing force of said fixing roller is set at 6 kg. On the other hand, the temperature on the outer circumferential surface of the heating roller in the second fixing device 23 is set at a temperature range in which fixation of second toner is possible (140° to 175° C.), preferably at 160° C.

Accordingly, almost all the first toner is melted and fixed to a sheet upon heating by the first fixing device 13 to 180° C. since the temperature range in which fixation of first toner which is transferred to a sheet is possible is 165° to 210° C. Next, the second toner is superimposed over the first toner and said sheet is transferred to second fixing device 23 where it is heated to 160° C. At this time, almost all second toner is melted and fixed to said sheet since the temperature range in which fixation is possible is 140° to 175° C. However, most of the first toner remains unmelted even if heated by the second fixing device 23 since this temperature (160° C.) is outside of the temperature range in which fixation of first toner is possible (165° to 210° C.). Thus, the first toner does not remelt, run on the sheet, or smudge with the second toner.

The temperature of the fixing device must be adjusted as a function of various conditions since toner has different fixation properties depending on the diameter of the fixing roller and the fixation pressure, even if the toners have identical constituents.

Figure 5:
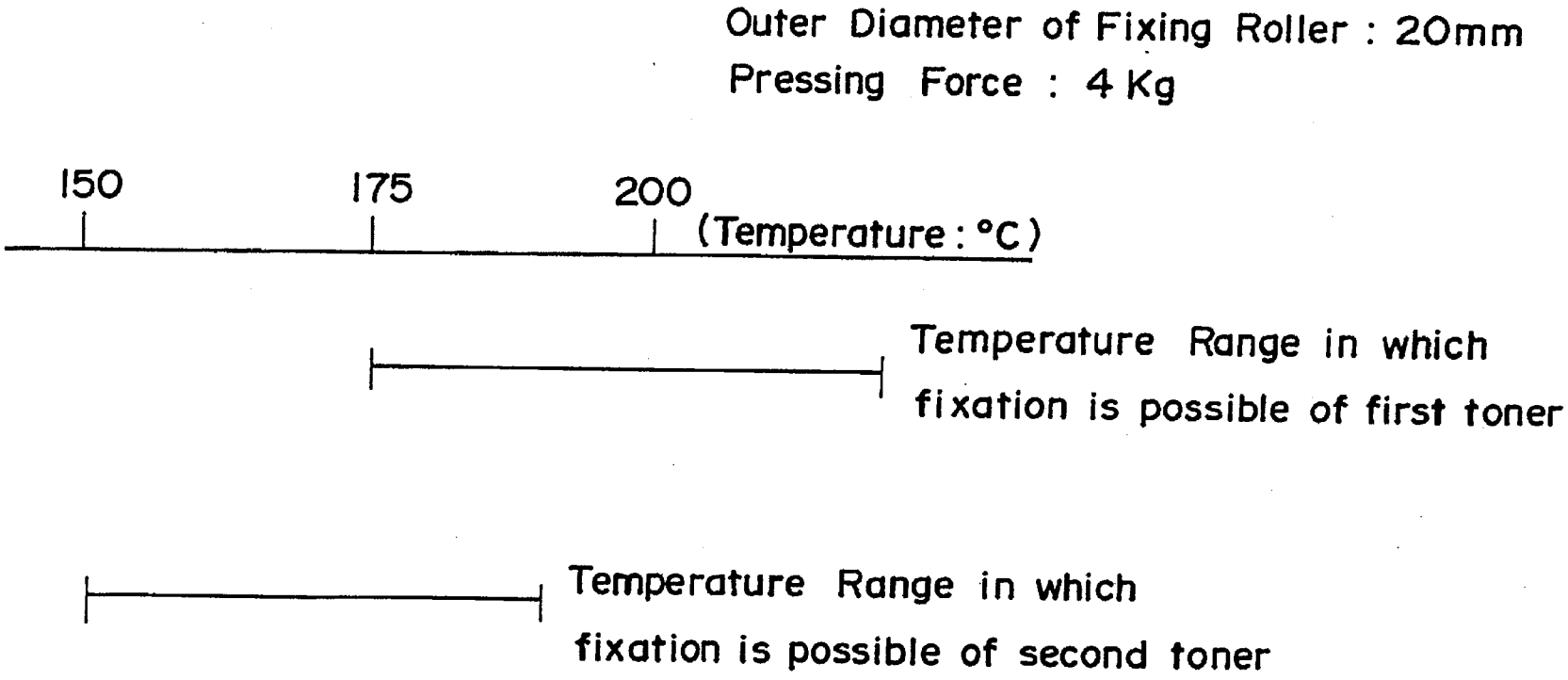
FIG. 5 is a diagram showing the temperature range in which fixation of the first toner and the second toner is possible when using a fixing roller having a 20 mm outer diameter and a 4 kg pressing force as well as the set temperatures of the first fixing device and the second fixing device.

Experiments carried out by the inventors confirmed that the temperature range in which fixation is possible could be altered in the range of 175° to 220° C. for the first toner and the range of 150° to 190° C. for the second toner when the diameter of a fixing roller is 20 mm and the fixation pressure is set at 4 kg in aforementioned embodiment (refer to FIG. 5). The reason is believed to be the change in the contact surface area (nip) between two fixing rollers as a function of the change in the pressing force. Accordingly, when a fixing device is designed for such conditions, the heating temperature of the first fixing device must be set in the range of 175° to 220° C. while the heating temperature of the second fixing device must be set in the range of 150° to 175° C.

Furthermore, the fixation temperature of a second fixing device would be set in a range of 150° to 175° C. when the fixation conditions of a first fixing device differ from those of a second fixing device, for example, when 6 kg of force are applied by a fixing roller of a first fixing device having an outer diameter of 20 mm and a length of 225 mm and 4 kg of force are applied by a fixing roller of identical outer diameter (20 mm outer diameter) in a second fixing device.

The first toner and second toner were fixed the same surface of a sheet in the aforesaid description, but they may be fixed to different surfaces. Furthermore, the present invention is applicable even when the first and second toner are of identical color. Furthermore, the printing material is not restricted to toner. In short, the present invention can be applied to any device which applies heat in molten fixation.

The present invention provides high-quality images without running or smudging of printing material in which there is little melting of a first printing material which had been previously fixed to a sheet when a second printing material is heated and melted, as described above, through the use of a dual image forming apparatus pursuant to the present invention.

Figure 6:
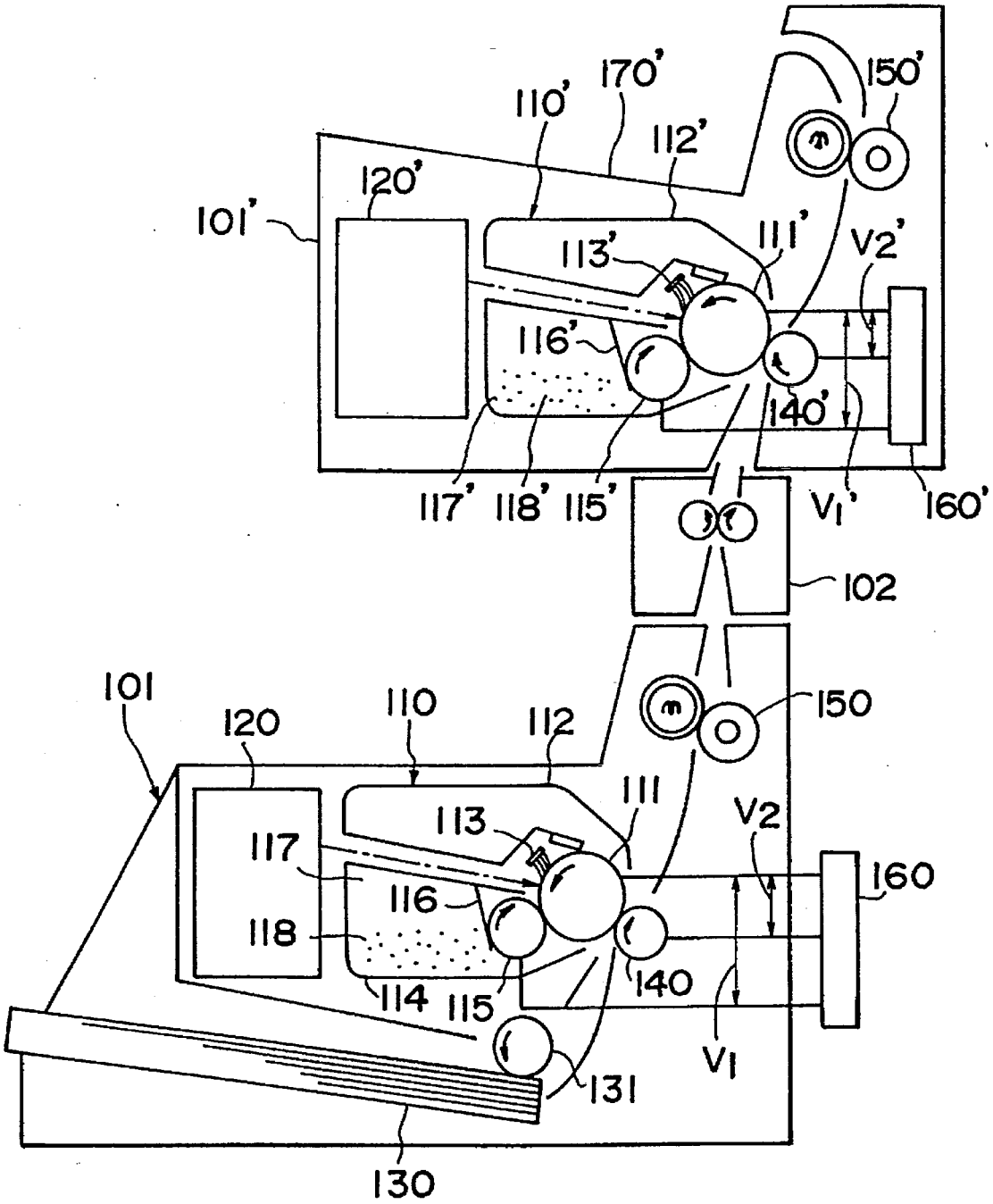
FIG. 6 is a view of an image forming apparatus according to a second embodiment of the present invention.

FIG. 6 illustrates the general structure of another dual image forming apparatus. Said image forming apparatus comprises a first printer 101 that creates a first image using a first printing material, specifically a first toner, on a sheet, a second printer 101' that creates a second overlapping image using a second printing material, specifically a second toner, on the aforementioned sheet, and a sheet transport device 102 that transports each sheet ejected from the first printer 101 to the second printer 101'.

The first printer 101 comprises an imaging unit 110, a printer head 120, a paper feeding device 130, a transfer device 140, a fixing device 150, and a bias power source device 160. The imaging unit 110 comprises a photosensitive drum 111, a cleaning device 112, a charge device 113, and a developing device 114. The imaging unit 110 is freely detachable from the body of the printer 101. The developing device 114 is provided with a developing roller 115 that faces the photosensitive drum 111 and a blade 116 that contacts an outer circumferential surface of the said developing roller 115. First toner 118 is stored in an empty chamber 117.

The second printer 101' is not provided with a paper feeding device, but is provided with a sheet discharge device 170'. Its structure otherwise is identical with that of the first printer 101. Accordingly, a description of the structure of the second printer 101' is omitted since identical notation with an apostrophe following the same number is applied to those sections which are identical with those of the first printer 101.

When the photosensitive drum 111 in the first printer 101 rotates in the counterclockwise direction in an image forming apparatus having the aforementioned structure, the outer circumferential surface of said photosensitive drum 111 is cleaned by the cleaning device 112, after which it is charged to a predetermined potential by a charger device 113. Next, imaging light from the laser head 120 is exposed on the outer circumference of said charged photosensitive drum 111 to form a first electrostatic latent image. The developing roller 115 is rotated in the clockwise direction in the developing device 114, and the first toner 118 is held on the outer circumferential surface facing the empty chamber 117. Said first toner 118 is regulated to a fixed amount at contact section of the blade 116, and it is given a charge of predetermined polarity through contact with the blade 116. Accordingly, a thin layer of the first toner 118 having a constant charge is formed on the surface of the developing roller 115 following passage of the toner through a contact section of the blade 116. First toner 118 is electrically-adhered to the image section of the aforementioned first electrostatic latent image on the developing roller 115 opposite photosensitive drum 111, and it becomes visible. The number of toner particles which adhere per unit area of the photosensitive drum 111 is determined by the potential difference V1 between the photosensitive drum 111 and developing roller 115 and by the amount of toner charge per particle.

Said first toner 118 is transferred at the section of the transfer device 140 opposing the photosensitive drum 111 onto a sheet which has been fed from the paper feeding device 130 by a paper feed roller 131. Said transfer is carried out based on an electric field which is formed between the photosensitive drum 111 and the transfer device 140. Specifically, when a transfer roller in transfer device 140 shown in FIG. 6, a sheet is charged by the transfer bias V2 which is applied between said transfer roller and the photosensitive drum 111, and charged first toner 118 is electrically attracted and adheres thereto. Furthermore when a wire electrode is run parallel to the photosensitive drum 111 in said transfer device 140, each sheet is charged through discharge of said wire electrode, and the first toner 118 is electrically attracted and stuck thereto. Sheets with toner adhering thereto are transported to the fixing device 150 where they are heated and the toner is molten fixed. Sheets which pass through the fixing device 150 are then fed to the second printer 101 via sheet transport device 102.

The same imaging processing is carried out in the second printer 101' as in the first printer 101, and an image using the second toner 118' is overlapped and created on each sheet on which an image had already been created using the first toner 118. Each sheet is then ejected through the sheet ejection device 170'.

In an image forming apparatus that creates an image using two types of toner 118 and 118', as discussed above, a sheet preceding heating by the fixing device 150 of first printer 101 has a different electrical resistance than a sheet following heating by the fixing device 150 because the moisture content of the sheet differs. Accordingly, electrical resistance of the latter sheet rises. As a result, the image density created by the second printer 101' would be lower than that of an image created by the first printer 101 when the transfer conditions of the first printer 101 and the second printer 101' are set identically, for example, the transfer bias applied to the transfer device 140' and the pressing force applied to the photosensitive drum of a transfer roller are set identically and toner having a same amount of charge per unit volume is used.

Accordingly, whether the toner particles have a large or a small particle diameter, even if uniformly large or uniformly small, the average particle diameter of second toner 118' should be greater than that of the first toner 118', since the amount of charge of each toner particle is identical. As a result, the amount of charge per unit volume of the second toner 118' would be less than that of first toner 118.

The number of toner particles adhering per unit volume of the first toner 118 and the second toner 118' would be identical if the amount of charge per particle of the first toner 118 and the second toner 118' are identical and if the transfer conditions other than toner are identical (for example, the electrical resistance of sheets, etc.). However, if the average particle diameter of the second toner 118' is greater than that of the first toner 118, the volume aggregate of the second toner adhering to each sheet would be greater than that of the aggregate of the first toner. Accordingly, a toner image created by the second toner 118' would have a higher density than a toner image created by the first toner 118. However, the electrical resistance of the sheets is higher in the second printer 101', and thus the transfer conditions of second toner 118' are worse in practice than those of first toner 118, as previously explained. Thus, the number of particles of the second toner 118' adhering to each sheet is lower than that of the first toner 118, and the decrease in the adhering number is compensated by the difference in volume of toner aggregate so that images of virtually identical density are obtained.

The inventors compared images created using a first toner with an average particle diameter of 11 μm and using a second toner with an average particle diameter of 13 μm, and found that the image density created by the second toner was virtually equal to that of an image created using the first toner. The amount of charge of toner aggregate per gram at this time for the first toner aggregate was −32 μC/g and for the second toner aggregate was −20 μC/g because of the difference in the number of toner particles contained in said aggregate. For comparison, the density of images created using a second toner was lower than that of images created using a first toner when using a first and a second toner having and average particle diameter of 11 μm.

The method of adjusting the amount of charge of the toner is not restricted to the aforementioned embodiment. Toner is charged through friction contact with the blade 116, as indicated above, and the amount of the charge which is provided to the toner aggregate passing through said blade contact section per unit time is constant, whether the amount of the toner is high or low. Thus, the pressing force of the developing roller 115 on the blade 116 is less in the second printer 101' than in the first printer 101, with the result being an increase in the amount of toner passing through. The amount of charge imparted to the toner per unit volume can be reduced by so doing.

Other means of controlling the charge include adjusting the amount of charge per unit volume of toner by adjusting the amount of charge controlling agent container in the toner, adjusting the type of resin comprising,toner or adjusting the constituent ratio of additives.

The aforesaid description addresses an electronic photographic printer using toner as a printing material, but the present invention is applicable to any device that electrically adheres printing material to sheets and fixes it through heat application. Furthermore, the color of the first toner and the second toner may be identical or different. The present invention is also applicable to image forming apparatus in which a first printer and a second printer apply toner to opposite surfaces of a sheet.

As explained above, the present invention concerns an image forming apparatus with a plurality of sets of imaging units which transfer printing material to a sheet through electrical power and heat the previously mentioned printing material to fix it to each sheet and in which a plurality of printing materials are fixed to a given sheet using said plurality of units. The amount of charge per unit volume of said printing material, which is stored in each imaging unit, may be adjusted so as to decrease if the sheet has already been processed with a first image. Accordingly, even sheets which have been heated by a prior imaging unit to reduce the moisture content thereof and raise the resistance would have a suitable amount of toner transferred via a latter imaging unit, and prescribed image density would be attained.

In addition, the principles set forth above could be applied to an image forming device that has only one photosensitive member and a plurality of developing devices. In such an embodiment, after a first latent image is created on the photosensitive member, the image is developed by a first developing device having a first toner therein. The developed image is then transferred to a sheet and is fixed by a conventional fixing device.

Then, instead of ejecting the sheet having the fixed image thereon, the sheet may be stored in an intermediate tray, while a second latent image is formed on the photosensitive member. The second latent image is then developed with a second toner having a smaller amount of charge per unit volume than the first toner. For example, the second toner may have an average particle diameter that is greater than that of the first toner.

The sheet is then retrieved from the intermediate tray and is sent to the photosensitive member where the second developed image is then transferred to the sheet. The transferred second image is then fixed on the sheet according to conventional methods.

Although only preferred embodiments are specifically illustrated and described herein, it will be appreciated that many modifications and variations of the present invention are possible in light of the above teachings and with the purview of the appended claims without departing from the spirit and intended scope of the invention.

What is claimed is:

1. An image forming apparatus comprising:

a first printing unit which forms a first image on a sheet with a first printing material and fixes the first image thereon by heat application; and a second printing unit which forms a second image with a second printing material on the sheet having the first image formed by the first printing unit, and fixes the second image thereon by heat application;

said second printing material has a lower melting temperature than the first printing material and said second printing unit applies a lower temperature heat for fixation of the second image than the first printing unit.

2. The image forming apparatus as claimed in claim 1, wherein said first printing material and said second printing material are toner of which the melting temperature may be adjusted by adjusting the blending rates of main constituent resins of toner which are high molecular-weight resin and low molecular-weight resin.

3. The image forming apparatus as claimed in claim 1, wherein almost all of the first printing material is melted by said first printing unit.

4. The image forming apparatus as claimed in claim 1, wherein the first printing unit fixes the first image by application of heat at a temperature range in which fixation is possible.

5. An image forming apparatus comprising:

a first imaging device which includes a first toner;

a first fixing device which is located downstream of the first imaging device with respect to a sheet feeding direction;

a second imaging device which is located downstream of the first fixing device with respect to the sheet feeding direction and includes a second toner which melts at a lower temperature than said first toner, said second imaging device arranged so as to form a second image with the second toner overlapping a first image formed with the first toner on the sheet and fixed with the first fixing device; and a second fixing device which is located downstream of the second imaging device with respect to the sheet feeding direction.

6. The image forming apparatus as claimed in claim 5, wherein said first fixing device fixes the first image on the sheet by heat at a first temperature, and the second fixing device fixes the second image on the sheet by heat with the lower temperature that is lower than the first temperature.

7. An image forming apparatus as claimed in claim 5, wherein said first toner and second toner include high molecular-weight resin and low molecular-weight resin, and the first toner has a higher proportion of high molecular-weight resin to low molecular-weight resin than the second toner.

8. The image forming apparatus as claimed in claim 5, wherein almost all of the first toner is melted by said first fixing device.

9. The image forming apparatus as claimed in claim 5, wherein the first fixing device fixes the first image by application of heat at a temperature range in which fixation is possible.

10. A image forming apparatus which is connectable to another image forming apparatus, and which another image forming apparatus forms a first image with a first toner and fixes the first image on a sheet by heat application, said image forming apparatus comprising:

an imaging device which includes a second toner which melts at a lower temperature than said first toner, said imaging device being located downstream of said another image forming apparatus with respect to a sheet feeding direction and forming a second image with the second toner overlapping the first image of the first toner on the sheet when the image forming apparatus is connected to said another image forming apparatus; and a fixing device located downstream of the imaging device with respect to the sheet feeding direction, said fixing device melting the second image of the second toner at the lower temperature to fix the second image on the sheet.

11. The image forming apparatus as claimed in claim 10, wherein said second toner has a lower proportion of high molecular-weight resin to low molecular-weight resin than the first toner.

12. An image forming apparatus which forms a first image with a first toner on a sheet and is connectable to another image forming apparatus which forms a second image with a second toner overlapping the first image on the sheet and fixes the second image thereon by heat application, said image forming apparatus comprising:

an imaging device which includes the first toner which melted at a higher temperature than said second toner, said imaging device being located upstream of said another image forming apparatus with respect to a sheet feeding direction and forming the first image with the first toner on the sheet when the image forming apparatus is connected to said another image forming apparatus; and a fixing device which is located downstream of the imaging device with respect to the sheet feeding direction, said fixing device melting the first image of the first toner at the higher temperature to fix the first image on the sheet.

13. The image forming apparatus as claimed in claim 12, wherein said first toner has a higher proportion of high molecular-weight resin to low molecular-weight resin than the second toner.

14. An image forming apparatus comprising:

a first printing unit which forms a first image with a first toner which is electrically charged, transfers the first image to a sheet via electric force, and fixes the first image on the sheet by heat application; and a second printing unit which forms a second image with a second toner which is electrically charged, transfers via electric force the second image to the sheet having the first image formed thereon by the first printing unit, and fixes the second image on the sheet by heat application;

wherein said second toner has less charge per unit volume than the first toner.

15. The image forming apparatus as claimed in claim 14, wherein an average particle diameter of the second toner is greater than that of the first toner and a charge amount of each toner particle is identical.

16. The image forming apparatus as claimed in claim 14, wherein each of the first and second printing units has a developing roller and a blade that contacts an outer circumferential surface of the developing roller so that the toner is charged through friction contact with the blade, and the pressing force on the developing roller of the blade is less in the second printing unit than in the first printing unit in order that the amount of charge per unit volume of the second is less than that of the first toner.

17. The image forming apparatus as claimed in claim 14, wherein an amount of charge per unit volume of said first and second toner is controlled by adjusting an amount of charge controlling agent contained in said first and second toner.

18. The image forming apparatus as claimed in claim 14, wherein an amount of charge per unit volume of said first and second toner is controlled by adjusting a type of resin in the toners.

19. An image forming apparatus comprising:

a first photosensitive member on which a first latent image is formed;

a first developing device which develops the first latent image with a first toner which is electrically charged;

a first transfer device which transfers the developed first image from the first photosensitive member to a sheet;

a first fixing device which melts the transferred first image of the first toner and fixes the transferred first image on the sheet;

a second photosensitive member on which a second latent image formed;

a second developing device which develops the second latent image with a second toner which has less charge per unit volume than the first toner;

a second transfer device which transfers the developed second image from the second photosensitive member to the sheet having the fixed first image thereon; and a second fixing device which melts the transferred second image of the second toner and fixes the transferred second image on the sheet.

20. The image forming apparatus as claimed in claim 19, wherein the average particle diameter of the second toner is greater than that of the first toner and a charge amount of each toner particle is identical.

21. The image forming apparatus as claimed in claim 19, wherein each of the first and the second developing device has a developing roller and a blade that contacts an outer circumferential surface of the developing roller so that the toner is charged through friction contact with the blade, and a pressing force between the blade and the developing roller is less in the second printing unit than in the first printing unit in order that the second toner has a less amount of charge per unit volume than the first toner.

22. The image forming apparatus as claimed in claim 19, wherein the amount of charge per unit volume of said first and second toner is controlled by adjusting an amount of charge controlling agent contained in said first and second toner.

23. The image forming apparatus as claimed in claim 19, wherein an amount of charge per unit volume of said first and second toner is controlled by adjusting a type of resin in the toners.

24. An image forming apparatus which is connectable to another image forming apparatus which forms a first image with a first toner which is electrically charged and fixes the first image on a sheet by heat application, said image forming apparatus comprising:

an imaging device which includes a second toner which has less charge per unit volume than the first toner, said imaging device being located downstream of said another image forming apparatus with respect to a sheet feeding direction and forming a second image with the second toner on the sheet having the first image when the image forming apparatus is connected to said another image forming apparatus; and a fixing device which is located downstream of the imaging device with respect to the sheet feeding direction, said fixing device fixes the second image on the sheet.

25. The image forming apparatus as claimed in claim 24, wherein an average particle diameter of the second toner is greater than that of the first toner and the charge amount of each toner particle is identical.

26. An image forming apparatus which forms a first image with a first toner on a sheet and is connectable to another image forming apparatus which forms a second image with a second toner overlapping the first image of the first toner on the sheet and fixes the second image thereon by heat application, said image forming apparatus comprising:

an imaging device which includes the first toner which has a greater charge per unit volume than said second toner, said imaging device being located upstream of said another image forming apparatus with respect to a sheet feeding direction and forming the first image with the first toner on the sheet when the image forming apparatus is-connected to said another image forming apparatus; and a fixing device which is located downstream of the imaging device with respect to the sheet feeding direction, said fixing device fixes the first image on the sheet.

27. The image forming apparatus as claimed in claim 26, wherein an average particle diameter of the first toner is less than that of the second toner and a charge amount of each toner particle is identical.

* * * * *